United States Patent [19]

Bell

[11] Patent Number: 4,522,126

[45] Date of Patent: Jun. 11, 1985

[54] GUN LAUNCHED IR CLOAKING DEVICE FOR VEHICLES

[75] Inventor: Frank H. Bell, Logan, Utah

[73] Assignee: Morton Thiokol Inc., Chicago, Ill.

[21] Appl. No.: 569,803

[22] Filed: Jan. 11, 1984

[51] Int. Cl.[3] ..... F42B 13/46; G01J 1/00

[52] U.S. Cl. ..... 102/370; 102/334; 102/439; 102/529; 343/18 A

[58] Field of Search ..... 102/370, 367, 439, 334, 102/336, 529; 343/18 A; 250/504 R; 350/1.5

[56] References Cited

U.S. PATENT DOCUMENTS

| | | | |
|---|---|---|---|
| 2,028,217 | 1/1936 | Huffman | 102/370 |
| 2,991,718 | 7/1961 | Ferguson | 102/529 |
| 3,170,405 | 2/1965 | Jungermann et al. | 102/529 |
| 3,726,218 | 4/1973 | Austin | 102/439 |
| 3,992,628 | 11/1976 | Karney | 102/367 X |
| 4,044,684 | 8/1977 | Gaggini et al. | 102/370 |
| 4,406,815 | 9/1983 | Magnusson et al. | 102/334 X |

*Primary Examiner*—David H. Brown
*Attorney, Agent, or Firm*—G. K. White

[57] ABSTRACT

A device comprising an infrared signature cloaking round forming part of the ammunition load of a cannon-armed vehicle provides an immediate response to a hostile threat from IR tracked or IR guided weapons by forming, when fired from the cannon, a mist that absorbs, scatters, reflects, refracts, or diffracts the infrared signature of the vehicle.

2 Claims, 1 Drawing Figure

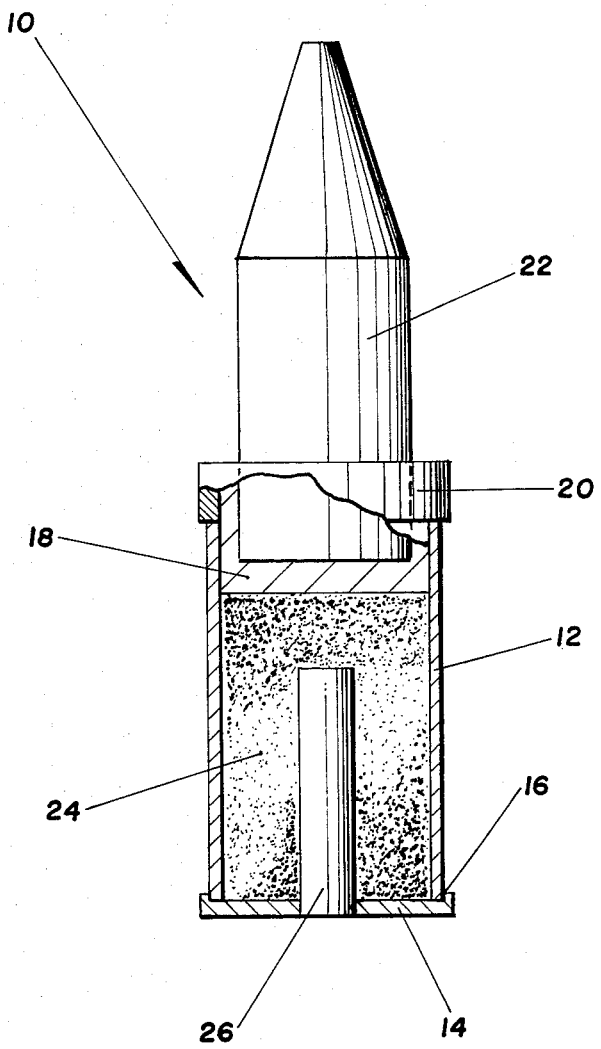
10
22
20
18
12
24
16
26
14

GUN LAUNCHED IR CLOAKING DEVICE FOR VEHICLES

BACKGROUND OF THE INVENTION

1. Field of the Invention

The present invention relates to a device resembling a round of ammunition that permits immediate response by a gun-armed combat vehicle such as a tank to a hostile threat from infrared (IR) tracked or IR guided weapons.

2. Description of the Prior Art

Antivehicular weapons that are guided by an IR beam or an IR laser are known. Some of these weapons feature IR "signature" homing. It has been proposed in the prior art to cloak or conceal a vehicle by spreading or dispersing an IR transmission attenuating aerosol from a drum to break up the vehicle's IR signature. Spreading an aerosol from a drum is slow, however, particularly when compared with the average flight time of a guided weapon. A quick and almost instantaneous response to such a hostile threat with an IR signature cloaking capability is needed.

SUMMARY OF THE INVENTION

An object of the invention is to provide a device that permits an immediate response by a gun-armed vehicle to a hostile threat from IR tracked or IR guided weapons.

Another object of the invention is to provide such a device that can be applied to any vehicle carrying a relatively large gun such as a cannon.

A further object of the invention is to provide for a gun-armed vehicle, a device comprising an IR signature cloaking round which is loaded while the vehicle is not engaged in a fire-fight whereby a response to a hostile threat can be made very quickly, with an IR signature cloaking capability, by firing the loaded gun.

Still another object of the invention is to provide for a gun-armed vehicle such immediate response capability to a hostile threat from IR tracked or IR guided weapons simply by changing the ammunition load of the vehicle.

In accomplishing these and other objectives of the invention, there is provided a gun launched infra-red cloaking device for cannon-armed vehicles comprising a cartridge case that includes a frangible canister with sabot type obturation. Packaged in the canister is a solution comprising an aluminum salt, such as Aluminum Sulfate ($AL_2(S0_4)_3$), dissolved in a water carrier. The cartridge includes a powder charge and suitable priming or activating means therefor, the powder charge desirably being of a smokeless type and just large enough to cause gun ejection of the canister, canister rupture, and solution nebulization. The mist resulting from solution nebulization absorbs, scatters, reflects, refracts, or diffracts the infrared signature of the vehicle. Also, an IR laser beam from a hostile tank gun sight or ranging device will be attenuated and scattered by the mist.

BRIEF DESCRIPTION OF THE DRAWINGS

Having summarized the invention, a detailed description follows with reference being made to the accompanying single FIGURE of drawing which forms part of the specification.

DESCRIPTION OF THE PREFERRED EMBODIMENT

The drawing illustrates a longitudinal cross-sectional view of the device according to the invention. The device, generally designated by the reference numeral 10, comprises a tubular cartridge case 12 and a base element 14. Base element 14 may be attached to the lower end of case 12, as seen in the drawing, by any suitable means, for example, as by welding or the use of a suitable adhesive 16. A cup-shaped member 18 which may be provided with a rotating band 20 is mechanically or adhesively attached to the upper end of case 12, rotating band 20 providing sabot type obturation. Positioned in and carried by the cup-shaped member 18 is a canister 22. Canister 18 may be mechanically or adhesively attached to member 18. A powder charge 24 of smokeless powder is contained in the case 12, and is ignited by suitable priming means 26 mounted in the base element 14. A smokeless powder is preferred for powder 24 because other types of powder have a higher heat signature.

In accordance with the invention, the canister 18 is made of a frangible material, for example, a plastic, which is easily broken and contains a solution comprising Aluminum Sulfate ($Al_2(S0_4)_3$) dissolved in a water carrier. Desirably, a conventional anti-freeze, for example, glycol, is mixed in the solution in suitable and adequate proportion to prevent freezing of the solution down to an extremely cold temperature of about −65° F. or a temperature in or below the range of temperatures at which combat vehicles such as tanks are likely to be operative. The plastic of which the canister 18 is made is of a type that is not reactive to the solution contained therein.

The powder charge 24 is selected to be just large enough to cause gun ejection of the canister, rupture of the canister and nebulization or atomization of the solution contained therein. The mist thereby produced absorbs, scatters, reflects, refracts, or diffracts the IR signature of the vehicle being cloaked.

Thus, there has been provided a device or anti-infrared round that permits an immediate response by a gun-armed vehicle to a hostile threat from IR tracked or IR guided weapons. If a gun-armed vehicle carried such an anti-infrared round loaded while not engaged in a fire-fight, it could respond to a hostile threat very quickly with an IR signature cloaking capability. The arrangement of the present invention thus permits almost instantaneous response to a hostile threat from IR tracked or IR guided weapons.

As those skilled in the art will understand, the device or anti-IR round can be applied to any vehicle carrying a relatively large gun or cannon. The invention is further characterized in that the device can be employed by simply changing the ammunition load of a cannon-armed vehicle.

I claim:

1. A gun launched infrared cloaking device for vehicles, comprising:

a cartridge case including a frangible canister with sabot type obturation, a solution including Aluminum Sulfate ($A1_2(S0_4)_3$) dissolved in a water carrier contained within said canister, and a powder charge of a smokeless type contained within said cartridge case, said powder charge being just large enough when fired from a gun to cause gun ejection of the canister, canister rupture and nebulization of the solution contained therein thereby to produce a mist around the vehicle that is impenetrable to infrared radiation.

2. A gun launched infrared cloaking device for vehicles as specified in claim 1 wherein said solution includes a conventional anti-freeze component therein to lower the temperature at which said solution will freeze.

* * * * *